US008371487B1

(12) United States Patent
Plappert

(10) Patent No.: US 8,371,487 B1
(45) Date of Patent: Feb. 12, 2013

(54) HANDGUN HOLSTER

(75) Inventor: William Joseph Plappert, Loxahatchee, FL (US)

(73) Assignee: Rhino Holsters Inc., Loxahatchee, FL (US)

( * ) Notice: Subject to any disclaimer, the term of this patent is extended or adjusted under 35 U.S.C. 154(b) by 522 days.

(21) Appl. No.: 12/433,078

(22) Filed: Apr. 30, 2009

(51) Int. Cl.
*F41C 33/02* (2006.01)

(52) U.S. Cl. ..... 224/193; 224/587; 224/911

(58) Field of Classification Search ..... 224/192–193, 224/198, 238, 243, 244, 245, 587, 674, 675, 224/911, 912
See application file for complete search history.

(56) References Cited

U.S. PATENT DOCUMENTS

| | | | | | |
|---|---|---|---|---|---|
| 2,213,472 | A | * | 9/1940 | Myres | 224/243 |
| 3,565,303 | A | * | 2/1971 | Kippen | 224/675 |
| 4,325,506 | A | * | 4/1982 | Lindell et al. | 224/243 |
| 4,424,924 | A | | 1/1984 | Perkins | |
| 4,544,089 | A | * | 10/1985 | Tabler | 224/192 |
| 4,577,787 | A | * | 3/1986 | Hersey | 224/243 |
| 4,787,540 | A | * | 11/1988 | Barry | 224/192 |
| 5,269,448 | A | * | 12/1993 | Shoemaker | 224/243 |
| 5,419,472 | A | * | 5/1995 | Hellweg et al. | 224/198 |
| 5,513,785 | A | | 5/1996 | Campagna, Jr. | |
| 5,551,613 | A | * | 9/1996 | Malinowski | 224/666 |
| 5,622,295 | A | | 4/1997 | Hellweg et al. | |
| 6,092,703 | A | * | 7/2000 | Johnson | 224/198 |
| 6,726,072 | B2 | * | 4/2004 | Rugh | 224/269 |
| 6,732,891 | B2 | | 5/2004 | Locklear, III | |
| 6,763,984 | B2 | | 7/2004 | Gallagher | |
| 7,204,395 | B2 | | 4/2007 | Gallagher | |
| 2002/0047029 | A1 | * | 4/2002 | Liao | 224/244 |
| 2004/0084494 | A1 | * | 5/2004 | Gilliam | 224/583 |
| 2006/0065689 | A1 | * | 3/2006 | Johnson | 224/675 |
| 2006/0175366 | A1 | | 8/2006 | Dekaise | |
| 2006/0219743 | A1 | | 10/2006 | Gallagher | |
| 2007/0175935 | A1 | | 8/2007 | Clifton | |

* cited by examiner

*Primary Examiner* — Justin Larson
*Assistant Examiner* — Adam Waggenspack
(74) *Attorney, Agent, or Firm* — Albert Bordas, P.A.

(57) ABSTRACT

A handgun holster comprising a holster assembly and a strap assembly. The holster assembly consists of a U-shaped exterior wall with top, bottom, and lateral edges. Extending from the top edge is a bend that defines a tension arm. Positioned within the exterior wall are bushings. The belt strap assembly has exterior and interior faces, third and fourth ends, and at least one hole. The belt strap assembly has female and male snaps adjacent to the ends. The male snap mounts onto a selected hole of the interior face by a screw that trespasses the first bushing and screws into a bolt. A second screw trespasses the second bushing and screws into a second bolt. The holster assembly is worn in between a waistband of an article of clothing and a belt. The tension arm is fitted over the waistband and the belt strap assembly wraps around the belt.

4 Claims, 3 Drawing Sheets

HANDGUN HOLSTER

BACKGROUND OF THE INVENTION

1. Field of the Invention

The present invention relates to holsters, and more particularly, to handgun holsters that fit in between a user's belt and pant waistband.

2. Description of the Related Art

Practical and secure holsters are often desired for increased firearm safety.

Applicant believes that one of the closest references corresponds to U.S. Patent Application Publication No. 2007/0175935 (A1), published on Aug. 2, 2007 to Clifton for a holster handgun locator and lock. However, it differs from the present invention because Clifton teaches a handgun that is releasably secured in a holster by a lever pivotally mounted to the holster carrying a forward locking member for positively engaging a handgun portion locking it in place. A rearward lever portion is movable by a user to pivot it away from engaging a handgun so that it can be withdrawn from the holster. A positioning member is affixed to a holster and engages the handgun, which may include a tension device. A muzzle positioner may be used to engage within the bore of the muzzle, which includes an alignment pin and an attachment fastener to the holster.

Applicant believes that another reference corresponds to U.S. Pat. No. 6,732,891 (B2) issued to Locklear, III on May 11, 2004 for a secure, quick-release handgun holster. However, it differs from the present invention because Locklear, III teaches a holster that includes: (a) a frame support (23) with an open top, comprising a bottom end (22) and at least one side panel (15); (b) a retention assembly (30) including a retention bracket (31), a retention plate (34) adjacent to a side of the retention bracket, and a trigger-impinging means (37) projecting from a side of the retention plate (34) into the retention bracket (31); (c) a spring-loaded actuator assembly (29) including an actuator (40) connected to an actuator arm (42), a portion of the actuator (40) extending through the side panel (15) to the outside, a portion of the actuator arm (42) extending inwardly through the side panel 15 into the retention bracket (31) and to the retention plate (34); and (d) a stabilizer spring assembly (79) including a stabilizer pin (81) having a base affixed to panel of the holster, and a movable power spring (80) substantially surrounding the stabilizer pin.

Applicant believes that another reference corresponds to U.S. Patent Application Publication No. 2006/0219743 (A1), published on Oct. 5, 2006 to Richard N. Gallagher for a canted universal elastic polymer holster hanger with indistinguishable belt lock and flex arm to conceal holster, to produce shirt-engaging flex cam surface, and to produce flexed gun securing surface. However, it differs from the present invention because Gallagher teaches a method and apparatus for flexing a concealed holster to secure the contents of the holster in the holster. An elongate substantially rigid elastically flexible sling is secured to a side of the holster such that the elongate member and side of the holster can be partially separated so the wearer's shirts can be inserted therebetween to conceal the holster. The lower end of the sling can be flexed outwardly away from the side of the holster such that a portion of the outer side adjacent the lower end is, when the sling is flexed outwardly to insert the wearer's shirt, flexed inwardly to compress a pistol in the storage compartment.

Applicant believes that another reference corresponds to U.S. Pat. No. 7,204,395 (B2) issued to Gallagher on Apr. 17, 2007 and U.S. Pat. No. 6,763,984 (B2) issued to Gallagher on Jul. 20, 2004 both for a canted universal elastic polymer holster hanger with indistinguishable belt lock and flex arm to conceal holster, to produce shirt-engaging flex cam surface, and to produce flexed gun securing surface. However, they differ from the present invention because Gallagher's patented inventions teach a method and apparatus for flexing a concealed holster to secure the contents of the holster in the holster. An elongate substantially rigid elastically flexible sling is secured to a side of the holster such that the elongate member and side of the holster can be partially separated so the wearer's shirts can be inserted therebetween to conceal the holster. The lower end of the sling can be flexed outwardly away from the side of the holster such that a portion of the outer side adjacent the lower end is, when the sling is flexed outwardly to insert the wearer's shirt, flexed inwardly to compress a pistol in the storage compartment.

Applicant believes that another reference corresponds to U.S. Patent Application Publication No. 2006/0175366 (A1), published on Aug. 10, 2006 to Daniel Dekaise for a security and retention device for a handgun. However, it differs from the present invention because Dekaise teaches an automatic safety and retention device for a gun holster, preferably for a handgun. The device comprises a cover (5) which connects the outer side (2) and the inner side (3) of the holster body at the top thereof and which pivots forward from a closed position to an open position under the action of at least one part of the hand of the carrier when the gun is being removed from the holster or spontaneously by the gun when it is being placed in the holster.

Applicant believes that another reference corresponds to U.S. Pat. No. 5,622,295 (B1) issued to Hellweg, et al. on Apr. 22, 1997 for a holster for handguns or the like. However, it differs from the present invention because Hellweg, et al. teaches a holster for a handgun comprising a holster body for receiving the handgun, the holster body being mounted on a belt receiving member; the holster body having an open top for receiving the handgun, and an open bottom to allow a barrel of the handgun to project therethrough if required; the holster body is of a folded construction having two substantially parallel but spaced apart ends shaped to conform with the barrel and/or slide of the handgun to define an open side therebetween, there being provided at least one adjustable tension means passing between the ends and across the open side to retain the ends in a desired but adjustable spaced relationship. Applicant believes that another reference corresponds to U.S. Pat. No. 5,513,785 (B1) issued to Campagna, Jr. on May 7, 1996 for a gun retention system. However, it differs from the present invention because Campagna, Jr. teaches a gun retention system for an officer to securely lock his weapon inside his holster while at the same time allowing quick and easy drawing of the weapon and maintaining a physical connection between the weapon and the officer's security belt. The gun retention system comprises a weapon grip, a security belt, and a spool housing. The weapon grip contains a connector, which attaches to the security belt and can be either right-handed or left-handed. The other end of security belt is connected to a spool and is coiled around the spool inside the spool housing. The spool housing can be mounted on the service belt directly behind an existing holder or can be integrally attached to a holster. A spool lock button on the spool housing provides safe and quick locking and unlocking of the gun inside the holster. The security belt does not interfere with the officer's ability to load, draw, aim and fire his weapon when needed. Tension in the security belt can be adjusted to the officer's desire. Applicant believes that another reference corresponds to U.S. Pat. No. 4,424,924 (B1) issued to Perkins on Jan. 10, 1984 for a holster with mounting spring. However, it differs from the present invention because Perkins teaches a holster for holding a handgun. The holster includes a generally U-shaped mounting spring under stiff tension against the exterior inside face of the holster. The mounting spring has a U-shaped fastening portion that fits into a pocket on the inside face of the holster. A fastener extends through the sidewall of the holster to secure the fastening portion of the spring to the holster. The holster can be worn without threading a belt through a belt loop on the holster. Instead, the mounting spring firmly but releasably clips the holster to the waistband of the user's trousers, or over the user's belt. The spring can be pulled away from the side of the holster against the bias of the spring to provide a gap for slipping the holster over the waistband or the belt, after which the spring is released, allowing the bias of the spring to clamp the holster firmly in place. The mounting spring has opposite legs extending alongside ridges formed on the inside face of the holster by a contour that matches the shape of the firearm. The legs of the spring therefore tightly clamp onto the user's clothing immediately next to and in line with the contour of the firearm, which tightly holds the holster in a fixed position. It can be used on other similar carrying cases, such as a knife sheath, or any other device, which can be clipped to not only a belt or waistband, but other articles, such as a boot or purse, for example.

Applicant believes that another reference corresponds to U.S. Pat. No. 4,325,506 (B1) issued to Lindell, et al. on Apr. 20, 1982 for a reinforcing arrangement for improving the strength and durability of a firearm holster. However, it differs from the present invention because Lindell, et al. teaches a reinforcing arrangement for strengthening the back seam and outer face of a holster for guns or like items. The reinforcing arrangement is comprised of a reinforcing piece, which is attached to the inner surface of the holster's outer wall. The reinforcing piece includes a protruding arm, which extends outward from the back seam. The protruding arm is folded around the back edge of the holster's outer wall so that a portion of the arm overlaps the outer surface of the outer wall. A rivet is then used to further secure the inner and outer walls of the holster to each other. The rivet passes through a channel which is formed by a hole in the portion of the arm which overlaps the outer surface of the outer wall, a hole in the outer wall of the holster, a hole in the portion of the arm which passes between the back edges of the holster's outer and inner walls, and a hole in the holster's inner wall.

Other patents describing the closest subject matter provide for a number of more or less complicated features that fail to solve the problem in an efficient and economical way. None of these patents suggest the novel features of the present invention.

SUMMARY OF THE INVENTION

The instant invention is a handgun holster that is secured in between a user's belt and pant waistband. More specifically, the present invention is a handgun holster, comprising a holster assembly comprising an exterior wall that generally forms a first U-shape. The exterior wall terminates at a top edge at a first end, and at a bottom edge at a second end. The exterior wall also comprises lateral edges. The lateral edges are approximately perpendicular to the top edge and the bottom edge. Extending from the top edge and adjacent to the lateral edge is a bend having sufficient curvature to extend and define a tension arm. The tension arm extends from the bend towards the bottom edge without reaching the bottom edge. Positioned within the first U-shape and between the top edge and the bottom edge are bushings.

A strap assembly comprises an exterior face and an interior face that generally forms a second U-shape. The exterior face and the interior face terminate at a third end and at a fourth end. The exterior face and the interior face have at least one hole that extends therethrough. The strap assembly has fastening means to fasten itself at a position adjacent to the third and fourth ends. The fastening means comprises a female snap adjacent to the third end that fastens onto a male snap adjacent to fourth end. The male snap is mounted onto the interior face by a screw that extends through a bushing and screws into a bolt. Another screw extends through the other bushing and screws into another bolt. The strap assembly is sufficiently long in length to perpendicularly wrap around a belt.

The holster assembly is worn in between a waistband of an article of clothing and a belt, whereby the tension arm is fitted over the waistband and the strap assembly perpendicularly wraps around the belt.

It is therefore one of the main objects of this invention to provide a handgun holster that is secured in between a user's belt and pant waistband.

It is another object of this invention to provide a handgun holster that may be adjusted for different belt widths.

It is another object of this invention to provide a handgun holster that is volumetrically efficient for carrying, transporting, and storage.

It is another object of this invention to provide a handgun holster, which is of a durable and reliable construction.

It is yet another object of this invention to provide such a holster that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
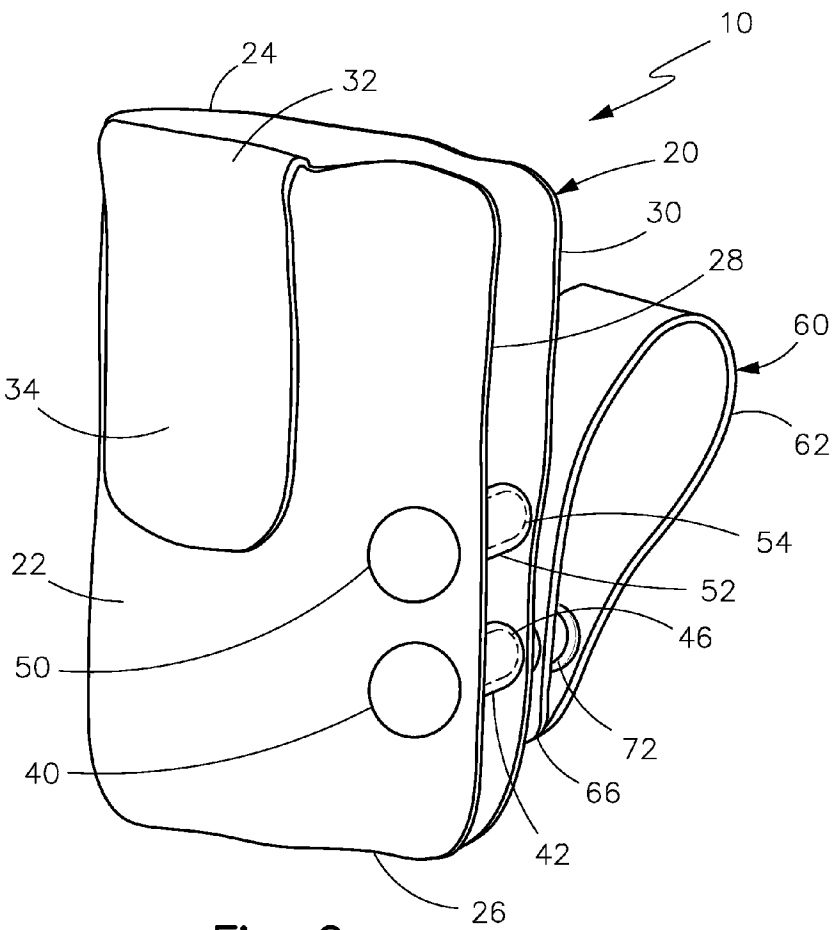
FIG. 2 is a second isometric view of the instant invention.

Referring now to the drawings, the present invention is generally referred to with numeral 10. It can be observed that it basically includes holster assembly 20 and strap assembly 60. Handgun holster 10 is made of a semi-rigid material such as plastic, acrylic, fiberglass, or any suitable material having similar characteristics.

Figure 1:
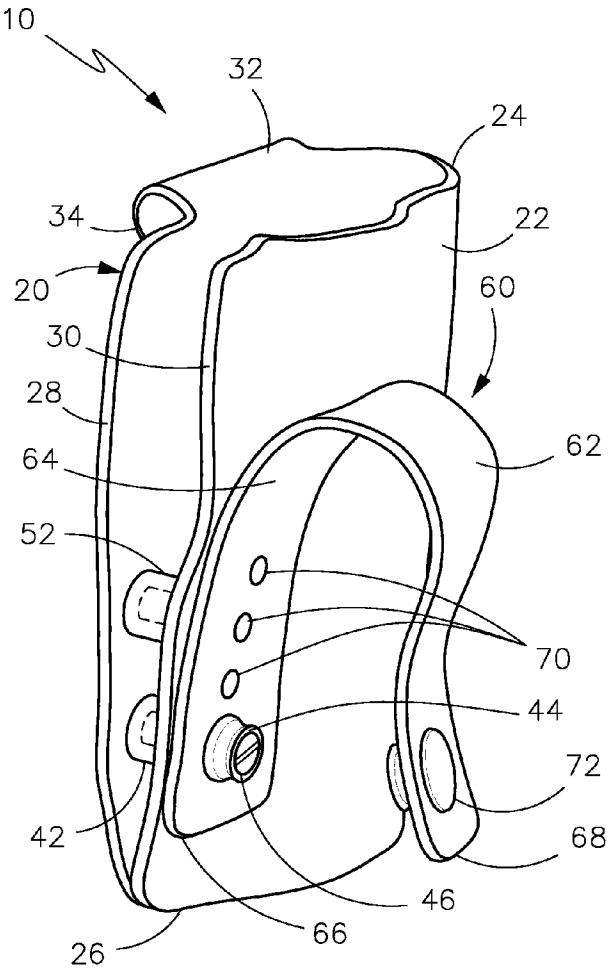
FIG. 1 represents a first isometric view of the handgun holster, object of the present application.

As seen in FIGS. 1 and 2, holster assembly 20 comprises exterior wall 22, which forms a U-shape. Exterior wall 22 terminates at top edge 24, defining a first end, and at bottom edge 26, defining a second end. Exterior wall 22 also comprises lateral edges 28 and 30 that are substantially perpendicular to top edge 24 and bottom edge 26. Positioned within U-shaped exterior wall 22, and between top edge 24 and bottom edge 26 are bushings 42 and 52.

Strap assembly 60 comprises exterior face 62 and interior face 64 that define another U-shape. Exterior face 62 and interior face 64 both terminate at ends 66 and 68. Exterior face 62 and interior face 64 have holes 70 that extend therethrough. Strap assembly 60 has fastening means to fasten itself at a position adjacent to ends 66 and 68. Such fastening means comprises female snap 72 adjacent to end 68 that fastens onto male snap 44 adjacent to end 66. Male snap 44 is mounted onto interior face 64 by screw 46 that extends through bushing 42 and screws into bolt 40. Screw 54 extends through bushing 52 and screws into bolt 50.

As best seen in FIG. 2, extending from top edge 24 of holster assembly 20 and adjacent to lateral edge 28, is bend 32, which has sufficient curvature to extend and define tension arm 34. Tension arm 34 extends from bend 32 towards bottom edge 26 without reaching bottom edge 26.

Figure 3:
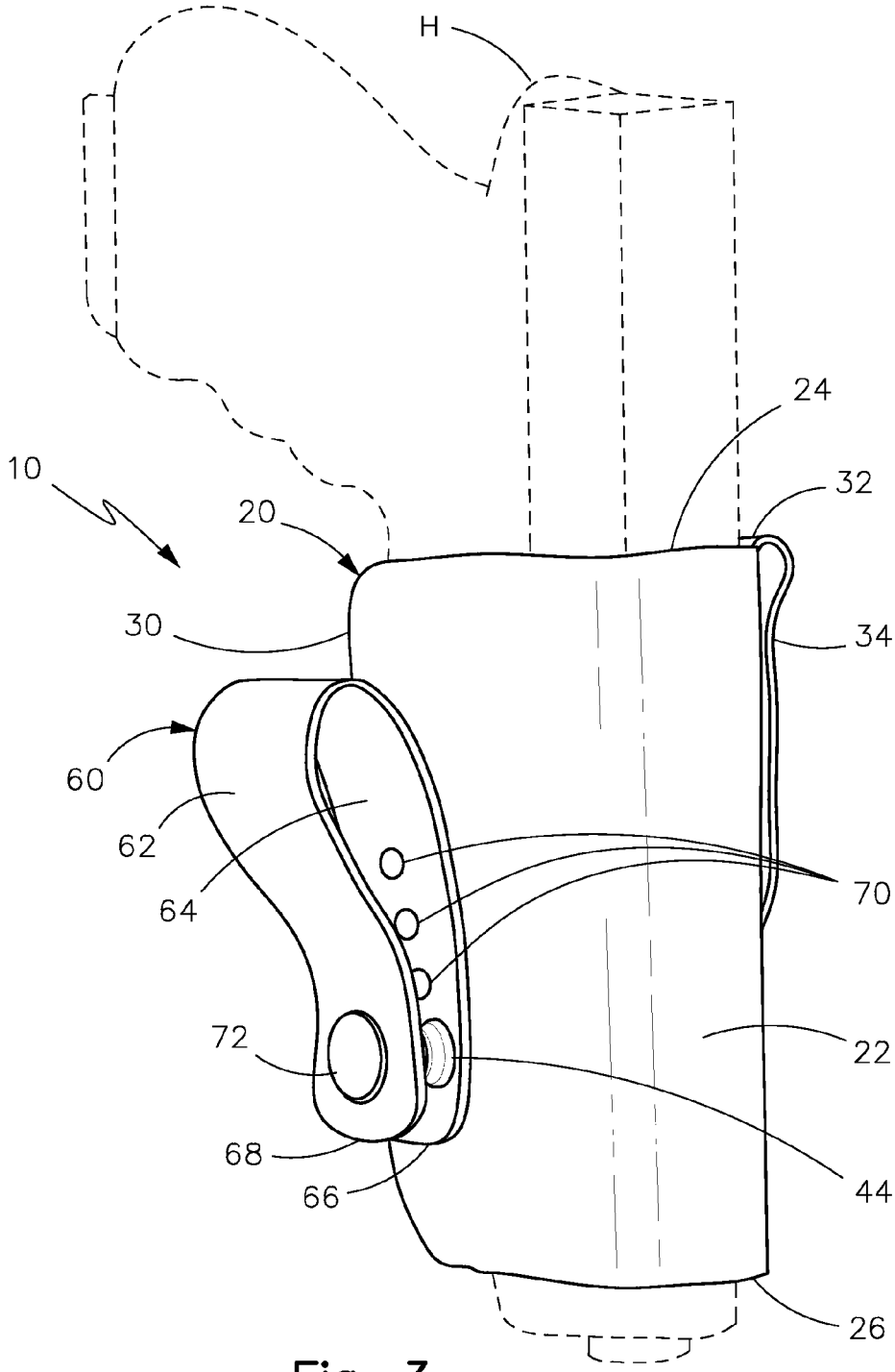
FIG. 3 is a third isometric view of the instant invention, with a handgun holstered therein.

As seen in FIG. 3, handgun H is removably received within handgun holster 10. Strap assembly 60 may be adjusted by selecting a desired hole 70 and passing screw 46 within male snap 44 therethrough, therefore allowing a user to adjust strap assembly 60 according to various belt widths.

Figure 4:
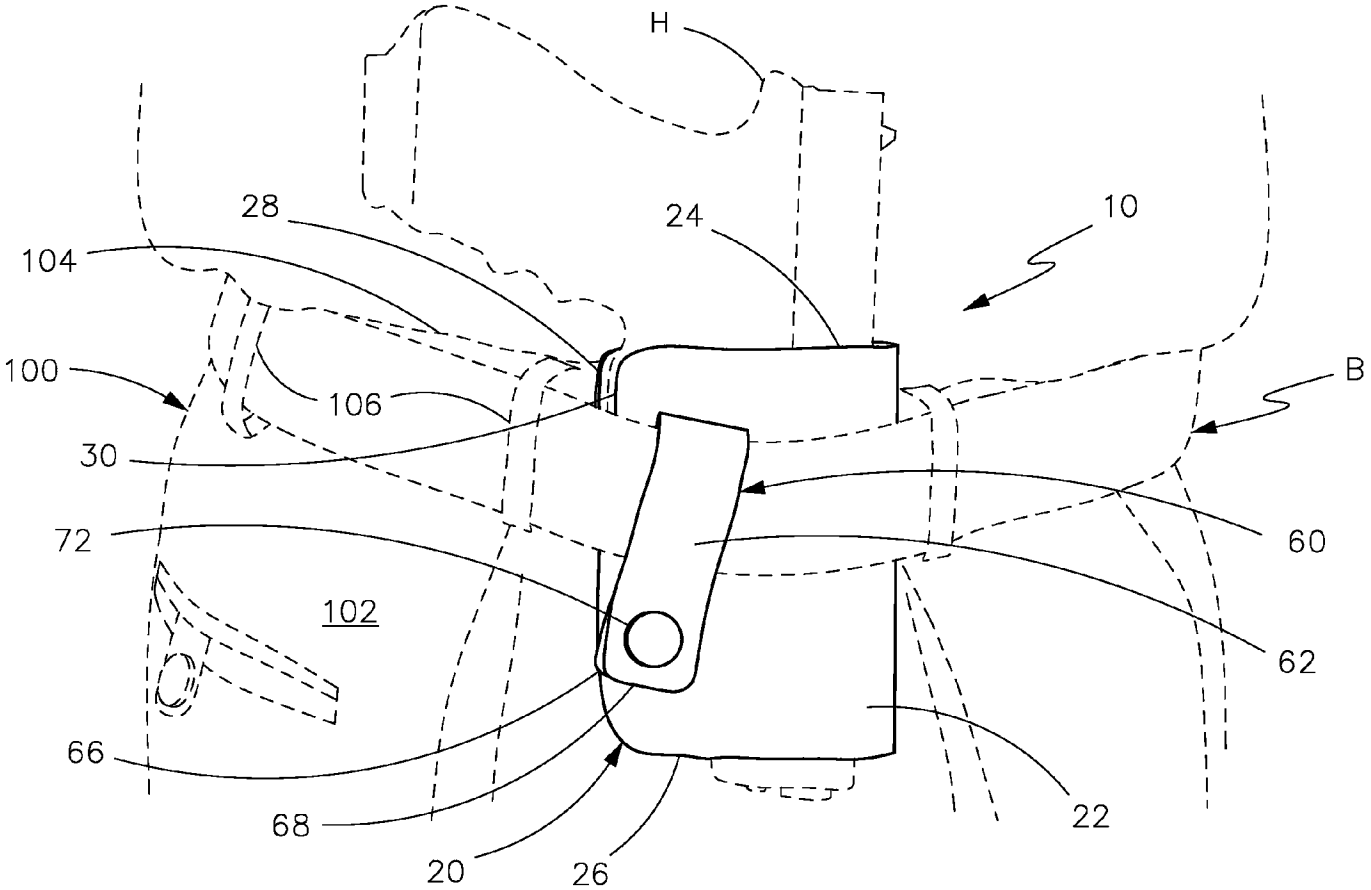
FIG. 4 is a fourth isometric view of the instant invention with the handgun holstered therein, and secured in between a user's belt and pant waistband.

As seen in FIG. 4, strap assembly 60 is of a cooperative length to perpendicularly wrap around belt B. Holster assembly 20 is worn in between a waistband 104 of an article of clothing 100 and belt B, whereby tension arm 34 is fitted over waistband 104 and strap assembly 60 perpendicularly wraps around a belt B. Although not illustrated, it is clear that when tension arm 34 is fitted over waistband 104, tension arm 34 is positioned on an interior side of article of clothing 100, as opposed to its visible exterior side illustrated in this figure. Article of clothing 100 may be pant 102, or any other article of clothing having belt loops 106 to support belt B. Such an article of clothing having belt loops 106 to support a belt B can be, but is not limited to, police apparel and/or uniforms, military apparel and/or uniforms, uniforms, jumpsuits, pants, shorts, or any other article of clothing covering at least a lower torso of the user.

When holstered as illustrated in FIG. 4, instant invention 10 provides the user confidence that handgun H is safely secured and accessible; whereby the user has control of handgun H fixed in between his/her waistband 104 and his/her belt B.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A handgun holster, consisting of:

A) a holster assembly (20) comprising a wall (22) that defines a first U-shape, said wall (22) terminates at a top edge (24) and at a bottom edge (26), said wall (22) also comprises first and second lateral edges (28 and 30), said first and second lateral edges (28 and 30) are substantially perpendicular to said top edge (24) and said bottom edge (26), extending from said top edge (24) and adjacent to said first lateral edge (28) is a bend (32), a tension arm (34) extends from said bend (32) towards said bottom edge (26) without reaching said bottom edge (26), positioned between said top edge (24) and said bottom edge (26), said wall (22) comprises first and second bolts (50 and 40), positioned within said first U-shape and between said top edge (24) and said bottom edge (26), said holster assembly (20) further comprises first and second bushings (42 and 52), said first bolt (50) is aligned with said first bushing (52) and said second bolt (40) is aligned with said second bushing (42), said holster assembly (20) further comprises first and second screws (54 and 46); and B) a strap assembly (60) consisting of an exterior face (62) and an interior face (64), said exterior face (62) and said interior face (64) define a second U-shape, said exterior face (62) and said interior face (64) have a first end (66) and a second end (68), said strap assembly (60) has plurality of through holes (70), said strap assembly (60) also comprises a female snap (72) and a male snap (44), said female snap (72) is adjacent to said second end (68) and fastens onto said male snap (44) that is adjacent to said first end (66), said male snap (44) is mounted onto said interior face (64) by said first screw (46), said first screw (46) extends through said first bushing (42) and screws into said first bolt (40), and said second screw (54) extends through said second bushing (52) and screws into said second bolt (50), said strap assembly (60) mounted onto said wall (22) oppositely from said tension arm (34), said plurality of through holes (70) are lineally aligned to permit adjustment of said strap assembly (60), said belt strap assembly (60) is sufficiently long in length to perpendicularly wrap around a belt (B), said holster assembly (20) is worn in between a waistband (104) of an article of clothing (100) and said belt (B), whereby said tension arm (34) is fitted over said waistband (104) and said belt strap assembly (60) perpendicularly wraps around said belt (B).

2. The handgun holster set forth in claim 1, further characterized in that said tension arm (34) is fitted over said waistband (104), whereby said tension arm (34) is positioned on an interior side of said article of clothing (100).

3. The handgun holster set forth in claim 2, further characterized in that said article of clothing (100) comprises belt loops (106) to support said belt (B).

4. The handgun holster set forth in claim 3, further characterized in that said article of clothing (100) is a pant, police uniform, military uniform, uniform, jumpsuit, short, or article of clothing covering at least a lower torso of a user.

* * * * *